United States Patent [19]

Inaguma

[11] Patent Number: 4,530,866

[45] Date of Patent: Jul. 23, 1985

[54] RUBBER ROLLER FOR SPINNING

[75] Inventor: Hideo Inaguma, Hirakata, Japan

[73] Assignee: Yamauchi Rubber Industry Co., Ltd., Hirakata, Japan

[21] Appl. No.: 541,272

[22] Filed: Oct. 12, 1983

[51] Int. Cl.[3] ..... B65H 57/14

[52] U.S. Cl. ..... 428/36; 428/29; 428/132

[58] Field of Search ..... 428/35, 36

[56] References Cited

U.S. PATENT DOCUMENTS 4,308,896 1/1982 Davis ..... 138/126

*Primary Examiner*—Christopher A. Henderson

*Attorney, Agent, or Firm*—Stiefel, Gross, Kurland & Pavane

[57] ABSTRACT

A rubber roller for spinning whose rubber cot comprises an inner and an outer rubber layer bonded together over a reinforcing layer consisting of a woven cloth or sheeting and fitted securely on the outer periphery of a metal core for roller, without using an adhesive and the manufacturing method thereof.

11 Claims, 3 Drawing Figures

RUBBER ROLLER FOR SPINNING

BACKGROUND OF THE INVENTION

1. Field of the Invention

The present invention relates to a rubber roller for spinning and manufacturing method thereof. More particularly it relates to a rubber roller for spinning improved in durability with its specific cylindrical rubber cot force-fitted on a metal roller core without using any adhesive and the manufacturing method thereof.

2. Description of the Prior Art

Hitherto a widely used rubber roller for spinning has been what comprises a rubber cot adhesive-bonded to and around a metal roller core. Such an adhesive-bonded rubber roller, however, has a drawback of the bondage being gradually lost as the roller is used prolongedly to possibly result eventually in the rubber layer coming off. The force-fitting method, in which a rubber cot with its bore somewhat smaller than the outer diameter of a metal roller core is mechanically fitted on the latter's outer periphery, is, therefore, being increasingly applied for manufacture of rubber rollers. A rubber roller of this force-fitted type, which is easy to assemble as it is, however, has a drawback of the rubber cot coming off the core rather easily due to insufficient fitting.

Meanwhile, there has been a proposal to cover the bore of a rubber cot with a textile layer and have it adhesive-bonded to the surface of a metal roller core. The rubber roller so made is superior in bondage attainable to its counterpart without textile lining, i.e. with simple rubber cot, but with it, too, the rubber cot tends to come off in prolonged use, leaving something to be desired about durability.

In another prior art example (U.S. Pat. No. 2,597,858) it is proposed to make the rubber cot consisting of three layers, namely an outer rubber layer, intermediate rubber layer and inner rubber layer, and embed glass cords in the intermediate rubber layer for reinforcement. Since this rubber roller is made up of three rubber layers, however, it is difficult to make, especially when its rubber cover is thin, as thin as 2–3 mm. Further, since glass cords are embedded in the intermediate rubber layer, expansibility of the inner rubber layer is reduced thereby, this making it difficult to fit the cot on the metal roller core.

According to the present invention, which is aimed at overcoming the defects of the conventional rubber rollers for spinning, fitting of a rubber cot on a metal roller core in the manufacture of a rubber roller is facilitated, and the rubber roller manufactured is definitely improved in durability with the cot being safer from coming off or peeling, being thus suited for use in spinning.

SUMMARY OF THE INVENTION

Thus, according to the present invention, a rubber roller for spinning is provided which has a rubber cot comprising an inner and an outer rubber layer bonded together over a reinforcing layer consisting of a woven cloth or sheeting and fitted securely on the outer periphery of a metal roller core. Also, according to the present invention, there is provided a method of manufacturing a rubber roller for spinning wherein a belt-like laminated sheet consisting of a woven cloth or sheeting and unvulcanized rubber sheet pressed together is wound round a metal core for molding densely with the rubber layer inside, providing an outer cover of unvulcanized rubber layer, subsequently vulcanizing the whole and cutting, if necessary, after releasing from the metal core to the desired width for making a rubber cot comprising of an inner rubber layer, reinforcing layer and outer rubber layer, and this rubber cot is then closely fitted on a metal roller core.

DESCRIPTION OF THE PREFERRED EMBODIMENTS

Figure 1:
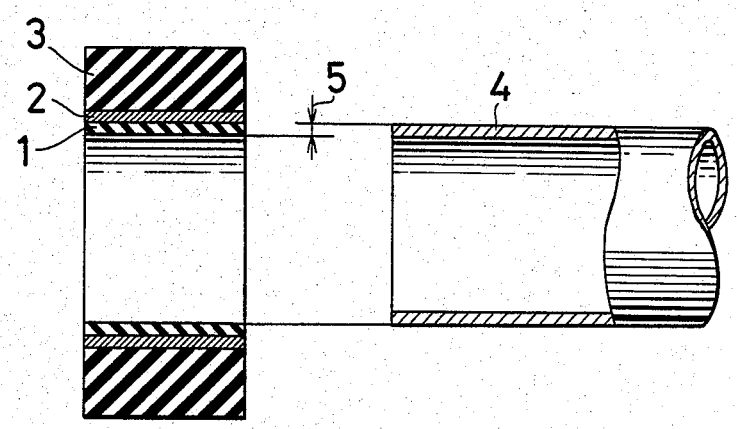
FIG. 1 is a sectional view showing an example of a rubber cot and metal core of a rubber roller for spinning of the present invention.
Figure 2:
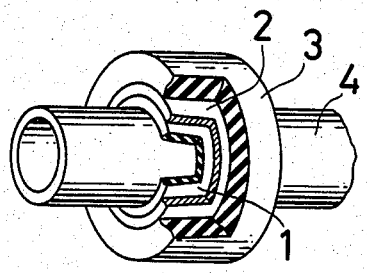
FIG. 2 is a partially broken-off perspective view showing an example of the rubber roller for spinning of the present invention.
Figure 3:
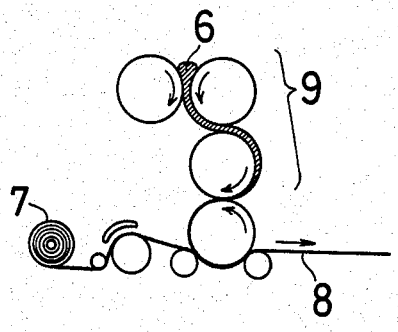
FIG. 3 is an illustratory sketch showing the process of forming an inner rubber layer and reinforcing layer of the rubber roller for spinning of the present invention.

With a rubber cot in 3-layer structure of the present invention, it is preferred that the thickness of an inner rubber layer 1 is 0.5–3.0 mm and that of a reinforcing layer 2 is 0.1–0.5 mm, and it is further preferred that the interference 5 between the cot and a metal core is between 0.5 and 2.0 mm, preferably 0.5–1.0 mm. If the thickness of the inner rubber layer is less than 0.5 mm, it rather badly interferes with fitting of the rubber cot on the metal core, this being thus unadvisable. It is also unadvisable to have the thickness of the inner rubber layer more than 3.0 mm, for the fitting tightness is then reduced to possibly cause early separation of the rubber cot off the metal core, i.e. early coming-off of the rubber cot. Nor is it advisable to have the thickness of the reinforcing layer less than 0.1 mm for compression on the metal core is then insufficient or more than 0.5 mm for the rubber elasticity of the cot is then affected. The thickness of the outer rubber layer 3 is not specifically limited according to the present invention, but its proper thickness may be approx. 3–30 mm as with ordinary rubber rollers for spinning. Further, for closely fitting the above rubber cot on the metal roller core 4 it is advisable to adjust the interference to 0.5–2.0 mm. If it is less than 0.5 mm, the rubber's contracting force is insufficient, while if it is more than 2.0 mm, insertion of the metal core is difficult. The most preferable range is 0.5–1.0 mm.

The materials for the inner rubber layer and the outer rubber layer according to the present invention are only required to be rubber elastomers, typically nitrile rubber, natural rubber, styrene-butadiene rubber, butadiene rubber, isoprene rubber or the like. The materials for both rubber layers may or may not be identical. For the outer rubber layer, however, preferred is nitrile rubber of good resistance to oil, while for the inner rubber layer preferred is nitrile rubber, natural rubber or styrene-butadiene rubber for reason of the required coefficient of friction as well as for cost reasons. It is also advisable to use for the inner rubber layer a material somewhat lower in hardness than that for the outer rubber layer, this being preferable for tightness of fitting on the metal core and also for resultant improvement in durability. The most preferred combination of rubber materials according to the present invention is such that in terms of hardness according to JIS K 6301-A it is 60°–85° for the inner rubber layer and 70°–90° for the outer rubber layer, preferably 65°–72° for the former and 70°–85° for the latter.

The reinforcing layer of the present invention may be any woven cloth or sheeting flexible with sufficient rigidity, and the sheeting should be very thin, e.g. a film. The reinforcing layer material may be one of various natural fibres, regenerated fibres, synthetic fibres, synthetic resins, metals etc. As the woven cloth material cotton or polyamide are preferred due to their tightening effect as well as for cost reasons. As the sheeting or film material a synthetic resin or metal is preferred. The synthetic resin may be a polyester such as polyethylene terephthalate or a polyamide such as 6-nylon or 6.6-nylon, preferred being uniaxially stretched film for its tightening effect on the metal core aluminum foil or the like. The most preferred material for the reinforcing layer is cotton or polyamide cloth.

The metal roller core of the present invention may be an iron core, preferably with its surface roughened, e.g. by grooving, for improved anchoring of the rubber cot.

In the manufacture of the rubber roller of the present invention, the first to be made is the rubber cot consisting of the inner rubber layer, reinforcing layer and outer rubber layer. The method for making the rubber cot consists in first pressing together an unvulcanized rubber sheet 6 as material of the inner rubber layer and a reinforcing material 7 to obtain a belt-like laminated sheet 8, then winding it around a metal core for molding once or a plurality of times, with the rubber layer inside, providing thereafter a cover layer of unvulcanized rubber as material of the outer rubber layer, releasing the resulting cot after subsequent vulcanization from the metal core, cutting it to the desired width and finally finishing it by grinding. The above-mentioned compressing method is not specifically limited but generally preferred is calendering or the like. In winding the laminated sheet round the metal core for molding, it is advisable to wind it densely without any gap but with care to avoid overlapping and finish with the thickness of the reinforcing layer as uniform as possible. The cover of the unvulcanized rubber, used as the material for the outer rubber layer, is preferably formed by the crosshead extrusion method or the like for better reproduction of the desired thickness, although there is no limitation about the method. A rubber cot consisting of the inner rubber layer, reinforcing layer and outer rubber layer in respective desired thicknesses can thus be obtained.

The rubber roller of the present invention is obtained by closely fitting the above rubber cot on the metal core for roller.

Thus, the rubber roller for spinning of the present invention comprises a rubber cot consisting of an inner rubber layer and outer rubber layer with an intervening reinforcing layer closely fitted on a metal core. The rubber roller is characterized in that insertion of the metal core is easily feasible, the tightening capability of the reinforcing layer is well exhibited after insertion of the metal core and, this acting together with contracting force of the inner rubber layer, the cot-metal core fitting tightness is quite high. Hence, there is no risk of the rubber cot coming off the metal core even in prolonged use and the durability of the rubber roller for spinning is improved remarkably.

Given below are examples for explanation in greater details of the present invention, but it is to be understood that the invention is by no means limited thereby.

EXAMPLE 1

A cotton cloth (thickness: 0.3 mm) and unvulcanized nitrile rubber sheet (hardness 70°, thickness: 1 mm) were pressed together by the use of a quadruple calender roll 9 for making a laminated sheet, and this sheet was cut to the predetermined width (20 mm). The resulting belt-like laminated sheet was wound spirally on the iron core of a proper configuration coated with a mold releasing agent with the reinforcing layer outside and with care to make the thicknesses of both layers uniform, and both ends were then fixed. This was then fed to a crosshead extruder for formation of a covering layer (thickness: 5 mm) of unvulcanized nitrile rubber (hardness 80°) over the reinforcing layer and subsequently it was vulcanized for 30 minutes at 160° C. in a vulcanizer. The vulcanized molding was then taken out of the vulcanizer, released from the iron core for molding, cut to the predetermined size and finished by grinding to a rubber cot (30 mm in outside diameter, 18.5 mm in inside diameter and 25 mm long). The rubber cot so prepared was then closely fitted on a metal core with the required interference (19 mm in outside diameter) by the fitting machine and a rubber roller for spinning of the present invention was thus manufactured.

With the rubber roller so manufactured a durability test was carried out under acceleration conditions of 15 kg in nip load and 200 rpm. in rotational speed, and the result was shown below in Table 1.

Shown as comparative example are the results of tests with rubber rollers 0.3 and 4.0 mm in inner rubber layer thickness.

TABLE 1

| Cot size | Reinforcing layer | Iron core O.D. | Inner rubber layer thick. | Test result |
|---|---|---|---|---|
| Rubber roller of this invention | | | | |
| 30 mm OD<br>18.5 mm ID<br>25 mm L | Cotton<br>0.3 mm | 19<br>mm | 2.0 mm | Not coming off core for more 1 month. (No abnormal indication in rubber layer or reinforcing layer) |
| Comp. example | | | | |
| 30 mm OD<br>18.5 mm ID<br>25 mm L | Cotton<br>0.3 mm | 19<br>mm | 0.3 mm | Reinforcing layer broken in 6 days. |
| Comp. example | | | | |
| 30 mm OD<br>18.5 mm ID<br>25 mm L | Cotton<br>0.3 mm | 19<br>mm | 4.0 mm | Cot came off core in 10 days. |

Thus, the rubber roller for spinning of the present invention turned out to have an outstanding durability.

EXAMPLE 2

A rubber roller shown in Table 2 was manufactured in the same way as in Example 1 except that aromatic polyamide cloth ("Cornex", Teijin's trade name) was used as the reinforcing material and a durability test was carried out in the same manner as described in Example 1. The result is shown in Table 2 below with data for rubber rollers 0.3 mm and 4.0 mm in inner rubber layer thickness as comparative example.

TABLE 2

| Cot size | Reinforcing layer | Iron core O.D. | Inner rubber layer thick. | Test result |
|---|---|---|---|---|
| Rubber roller of the invention | | | | |
| 30 mm OD 18.5 mm ID 25 mm L | Aromatic polyamide cloth 0.2 mm | 19 mm | 1.5 mm | Not coming off core for more than 1 month. (No abnormal indication in rubber layer or reinforcing layer) |
| Comp. example | | | | |
| 30 mm OD 18.5 mm ID 25 mm L | Aromatic polyamide cloth 0.2 mm | 19 mm | 0.3 mm | Reinforcing layer broken in 9 days. |
| Comp. example | | | | |
| 30 mm OD 18.5 mm ID 25 mm L | Aromatic polyamide cloth 0.2 mm | 19 mm | 4.0 mm | Cot came off core in 7 days. |

Thus, the rubber roller for spinning of the present invention in this example, too, turned out to have an outstanding durability just as that in Example 1.

What we claim is:

1. A rubber roller for spinning comprising a rubber cot force-fitted on a metal core with an interference in the range of 0.5–2.0 mm, said rubber cot having an inner and an outer rubber layer bonded together with an intermediate woven cloth or sheeting reinforcing layer, said inner rubber layer having a thickness in the range of 0.5–3.0 mm and said reinforcing layer having a thickness in the range of 0.1–0.5 mm.

2. The rubber roller according to claim 1 wherein the woven cloth is a cotton or polyamide woven cloth.

3. The rubber roller according to claim 2 wherein the rubber cot is fitted on the metal core with an interference in the range of 0.5–1.0 mm.

4. A rubber roller for spinning comprising a rubber cot force-fitted on the outer periphery of a metal roller core, said rubber cot having an inner and an outer rubber layer bonded together with an intermediate woven cloth or sheeting reinforcing layer, said inner rubber layer having a hardness in the range of 60°–85° and said outer rubber layer having a hardness in the range of 70°–90°.

5. The rubber roller according to claim 4 wherein the woven cloth is a cotton or polyamide woven cloth.

6. The rubber roller according to claim 5 wherein the rubber cot is fitted on the metal core with an interference in the range of 0.5–1.0 mm.

7. The rubber roller according to claim 4 wherein the inner rubber layer has a thickness in the range of 0.5–3.0 mm, the reinforcing layer has a thickness in the range of 0.1–0.5 mm and the rubber cot is fitted on the metal core with an interference in the range of 0.5–2.0 mm.

8. The rubber roller according to claim 4 wherein said inner layer has a hardness in the range of 65°–72° and said outer layer has a hardness in the range of 70°–85°.

9. The rubber roller according to claim 8 wherein the woven cloth is a cotton or polyamide woven cloth.

10. The rubber roller according to claim 9 wherein the rubber cot is fitted on the metal core with an interference in the range of 0.5–1.0 mm.

11. The rubber roller according to claim 8 wherein the rubber cot is fitted on the metal core with an interference in the range of 0.5–1.0 mm.

* * * * *

UNITED STATES PATENT AND TRADEMARK OFFICE

CERTIFICATE OF CORRECTION

PATENT NO. : 4,530,866

DATED : July 23, 1985

INVENTOR(S) : Hideo Inaguma

It is certified that error appears in the above-identified patent and that said Letters Patent is hereby corrected as shown below:

Column 3, line 9: after "material" insert --,--

Column 3, line 15: ", preferred being" should read --. The synthetic resin is preferably in the form of a--

Column 3, line 16: after "core" insert --. When a metal is used it is preferred to use--

Column 3, line 61: after "with" insert --the--

Signed and Sealed this

*Sixteenth* Day of *September 1986*

[SEAL]

*Attest:*

DONALD J. QUIGG

*Attesting Officer*

*Commissioner of Patents and Trademarks*